US006435501B2

(12) United States Patent
Naden

(10) Patent No.: US 6,435,501 B2
(45) Date of Patent: Aug. 20, 2002

(54) RANDOM NUMBER GENERATOR

(76) Inventor: Mark Cameron Naden, 55 Liberty St., Apt. 16B, New York, NY (US) 10005

( * ) Notice: Subject to any disclaimer, the term of this patent is extended or adjusted under 35 U.S.C. 154(b) by 0 days.

(21) Appl. No.: 09/827,338

(22) Filed: Apr. 5, 2001

Related U.S. Application Data

(60) Provisional application No. 60/197,285, filed on Apr. 14, 2000.

(51) Int. Cl.[7] ..... A63B 71/00

(52) U.S. Cl. ..... 273/144 A; 273/144 B; 273/144 R; 273/138.1; 273/138.2; D7/302; D7/354; D7/301; D7/303; D7/312

(58) Field of Search ..... 273/144 A, 144 B, 273/144 R, 138.1, 138.2; D7/354, 302

(56) References Cited

U.S. PATENT DOCUMENTS 3,224,779 A * 12/1965 Geleshko ..... 273/144 A
5,062,635 A * 11/1991 Tse et al. ..... 273/144 A
5,312,103 A * 5/1994 Chateau ..... 273/144 A
5,566,940 A * 10/1996 Powell ..... 273/144 A
5,702,101 A * 12/1997 Douglas ..... 273/144 B
D406,720 S * 3/1999 Strum et al. ..... D7/302
D413,755 S * 9/1999 Strum et al. ..... D7/302
D436,788 S * 1/2001 Strum et al. ..... D7/302
2001/0033055 A1 * 10/2001 Naden

* cited by examiner

*Primary Examiner*—Benjamin H. Layno
*Assistant Examiner*—Dolores R. Collins
(74) *Attorney, Agent, or Firm*—Mayer Fortkort & Wiliams, PC; Michael P. Fortkort

(57) ABSTRACT

A water kettle randomly selects lottery numbers as it boils water. The water kettle enables one to randomly select six numbers for a lottery game, such as the "Pick 6 Lotto" game. As heat is applied to the water kettle to boil water for tea, for example, through steam power generated by the boiling water, a set of balls is agitated. Each of the balls in the set has a number painted or otherwise associated with it. As the steam agitates the balls, the balls randomly drop into a tube. At the same time, the noise of the agitating balls alerts a user that the water has boiled. The design and colors of the kettle echo the themes of the lottery. Moreover, the shape of the kettle matches that of a lottery ball.

4 Claims, 8 Drawing Sheets

RANDOM NUMBER GENERATOR

This application claims benefit of Provisional No. 60/197,285 filed Apr. 14, 2000.

BACKGROUND OF THE INVENTION

The present invention relates generally to random number generators, and more particularly to a random number generator for generating a subset of numbers for a game of chance, such as a lottery.

Interest in games of change, such as lotteries, has expanded over the years, especially as the availability of lotteries has increased and the amount of potential winnings has increased as well. Along with this increase, many lottery players prefer to select their numbers rather than being assigned such numbers.

Devices for picking the numbers exist. For example, U.S. Pat. No. 5,702,101 discloses a handheld gaming ball display. This device enables a user to select a random series of balls bearing characters thereon.

However, many people prefer to select a number or numbers based on everyday events to feel a relationship with the numbers they are playing. This device does not establish the relationship with the user's life that many people prefer when selecting lottery numbers.

The present invention is therefore directed to the problem of developing a method and apparatus for selecting a lottery number that occurs as part of one's everyday life.

SUMMARY OF THE INVENTION

The present invention solves this problem by providing a water kettle that one can use for heating or boiling water that will generate a series of random numbers.

According to one aspect of the present invention, the kettle employs an agitator driven by a propeller, which in turn is driven by the steam generated by heating water. The agitator mixes a plurality of balls, each of which bears a unique character or number, and which randomly fall into a tube as a result of the agitation process.

BRIEF DESCRIPTION OF THE INVENTION

DETAILED DESCRIPTION

Figure 1:
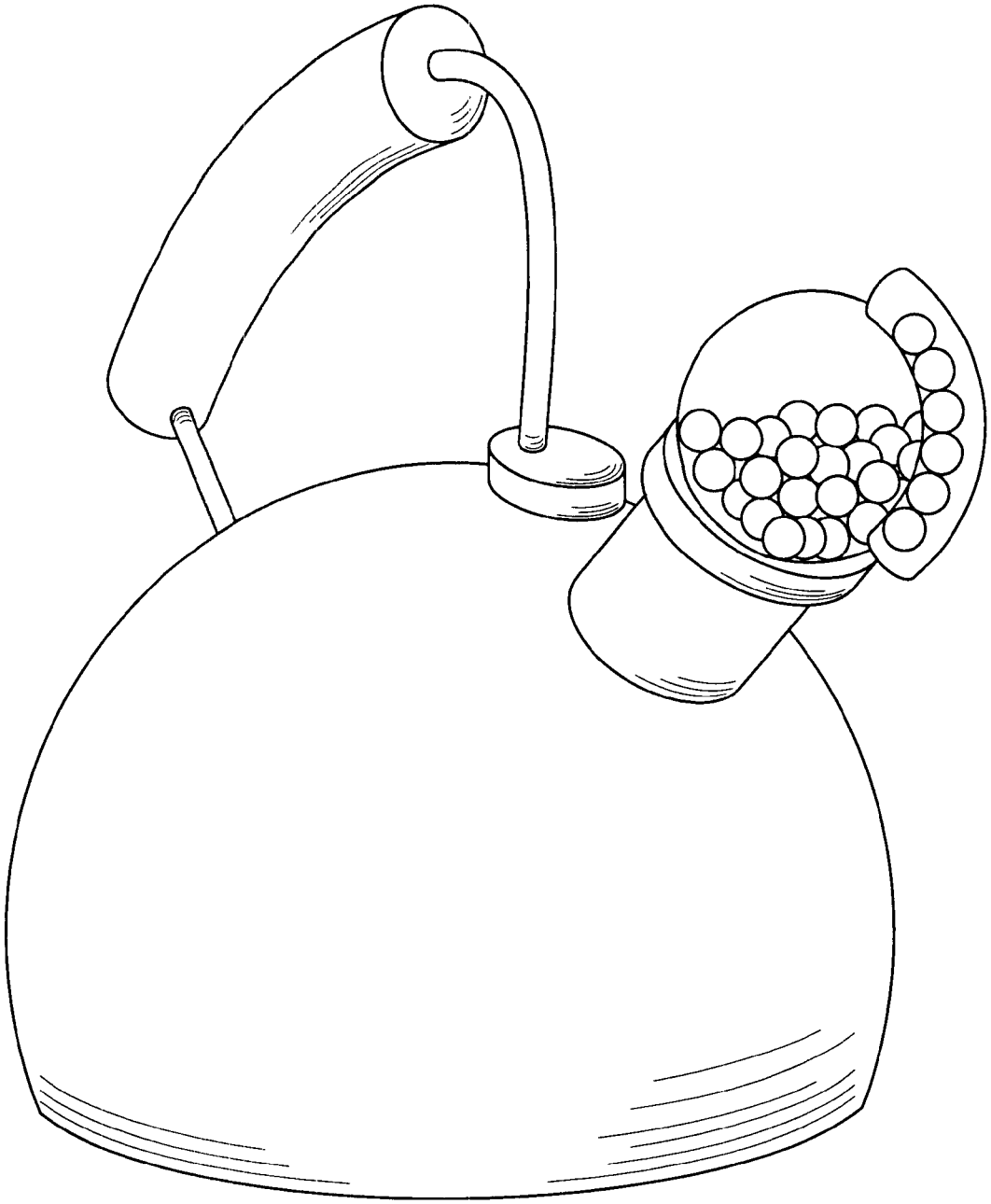
FIG. 1 depicts a perspective view of an exemplary embodiment of a "Pick 6 lotto" water kettle according to one aspect of the present invention.

Referring to FIG. 1, shown therein is an exemplary embodiment of a water kettle according to one aspect of the present invention. This embodiment is a water kettle that randomly selects lottery numbers as it boils water. For example, the water kettle may enable one to randomly select six numbers for a lottery game, such as the "Pick 6 Lotto" game.

As heat is applied to the water kettle to boil water for tea, for example, through steam power generated by the boiling water, a set of balls is agitated. Each of the balls in the set has a number painted or otherwise associated with it. As the steam agitates the balls, the balls randomly drop into a tube. At the same time, the noise of the agitating balls alerts a user that the water has boiled.

The design and colors of the kettle echo the themes of the lottery. Moreover, the shape of the kettle matches that of a lottery ball.

Figure 2:
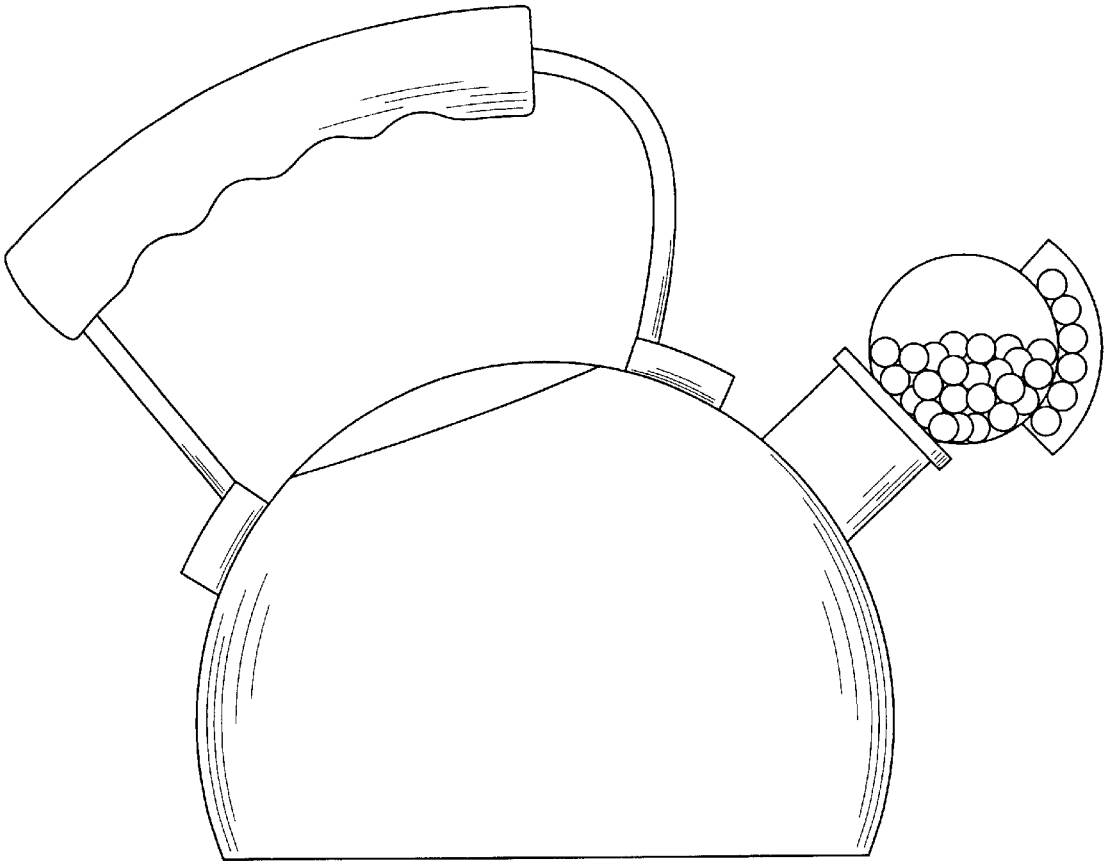
FIG. 2 depicts a rightside view of the exemplary embodiment of FIG 1.
Figure 3:
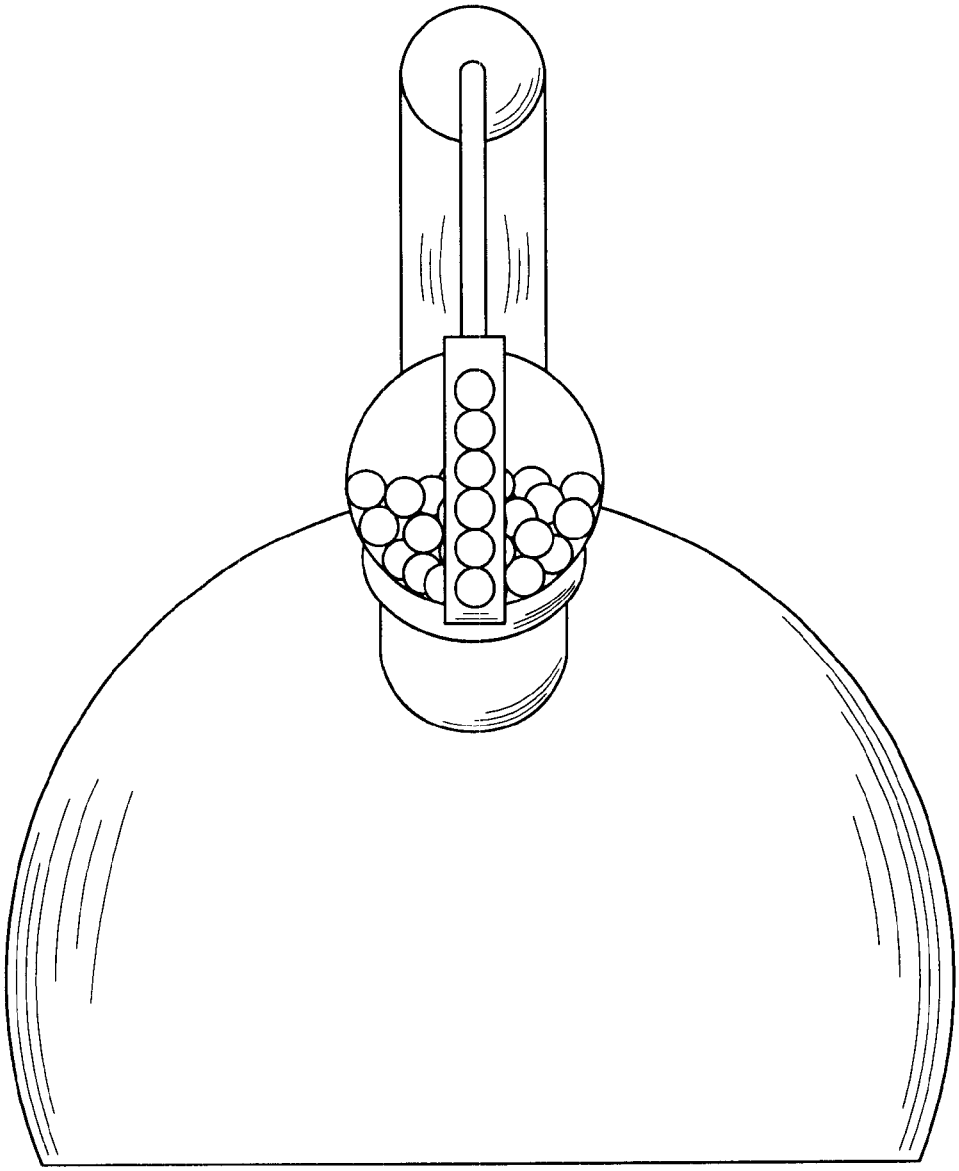
FIG. 3 depicts a front view of the exemplary embodiment of FIG. 1.
Figure 4:
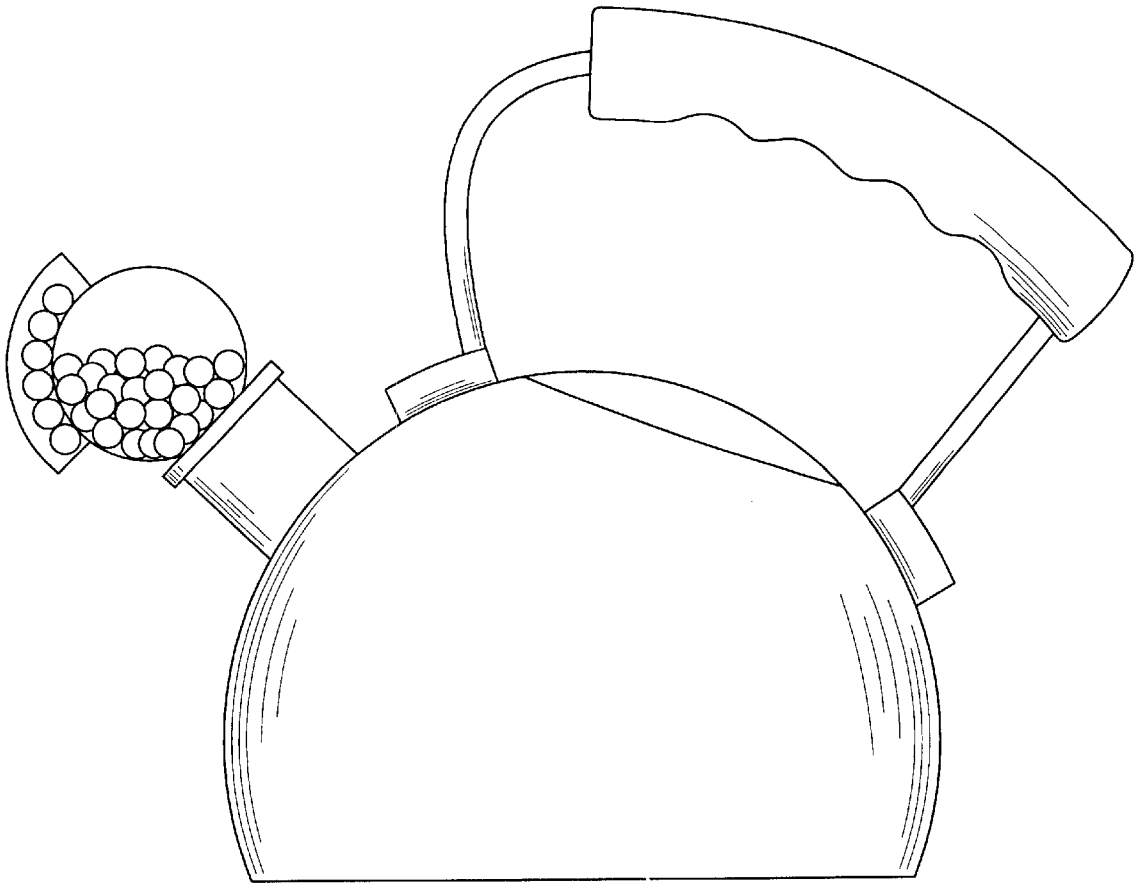
FIG. 4 depicts a left side view of the exemplary embodiment of FIG. 1.
Figure 5:
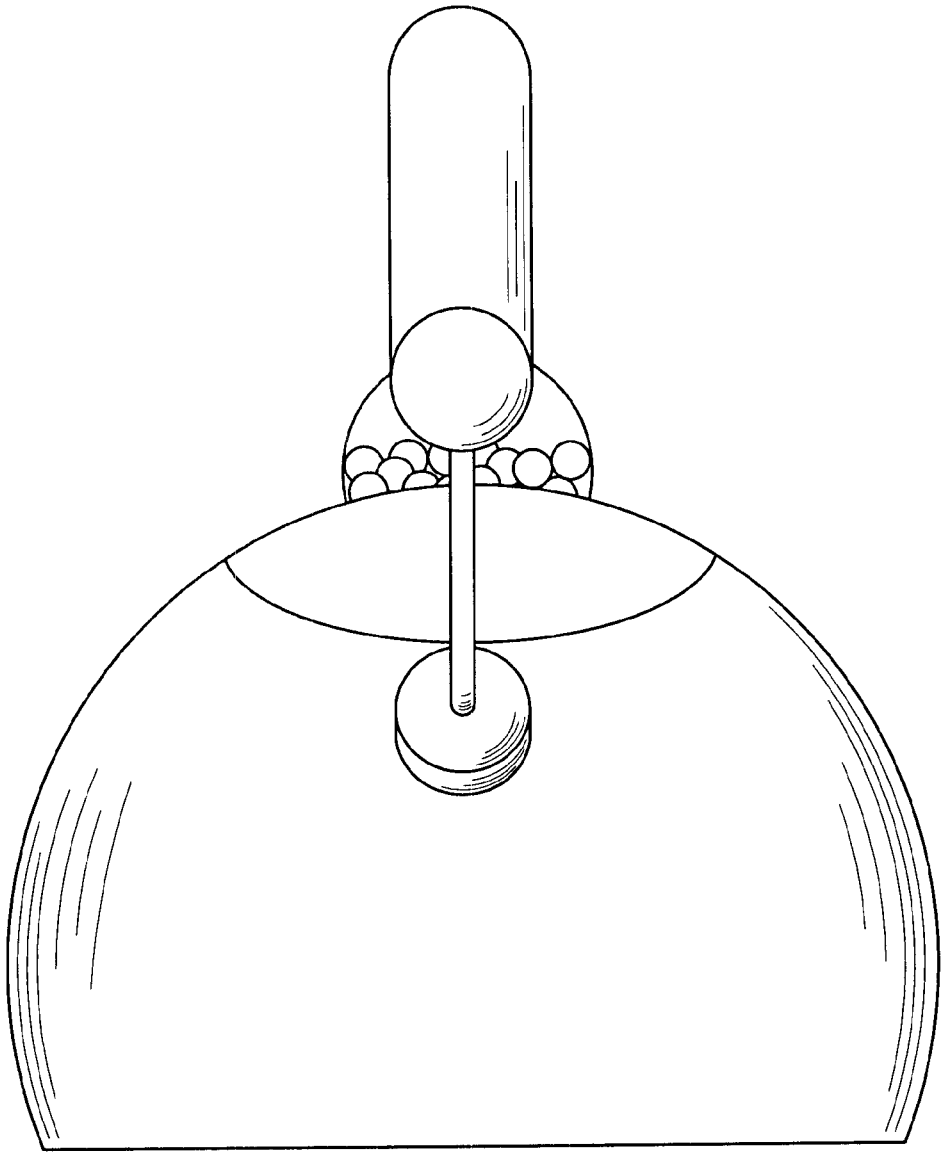
FIG. 5 depicts a back view of the exemplary embodiment of FIG. 1.
Figure 6:
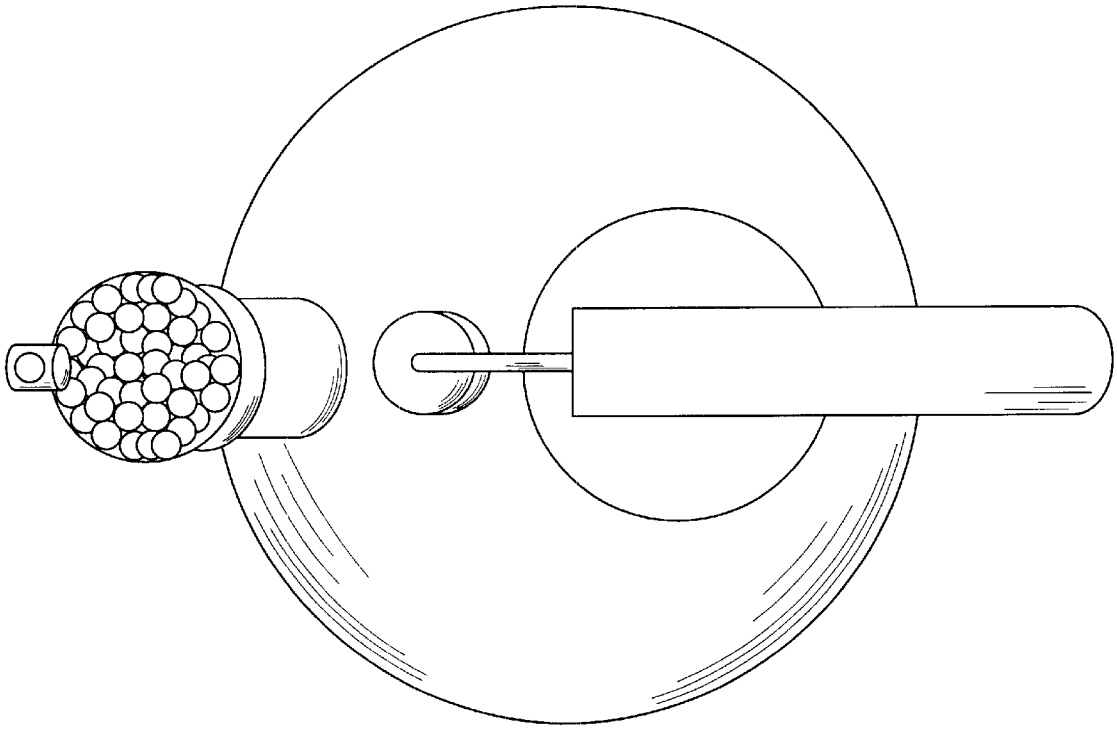
FIG. 6 depicts a top view of the exemplary embodiment of FIG. 1.
Figure 7:
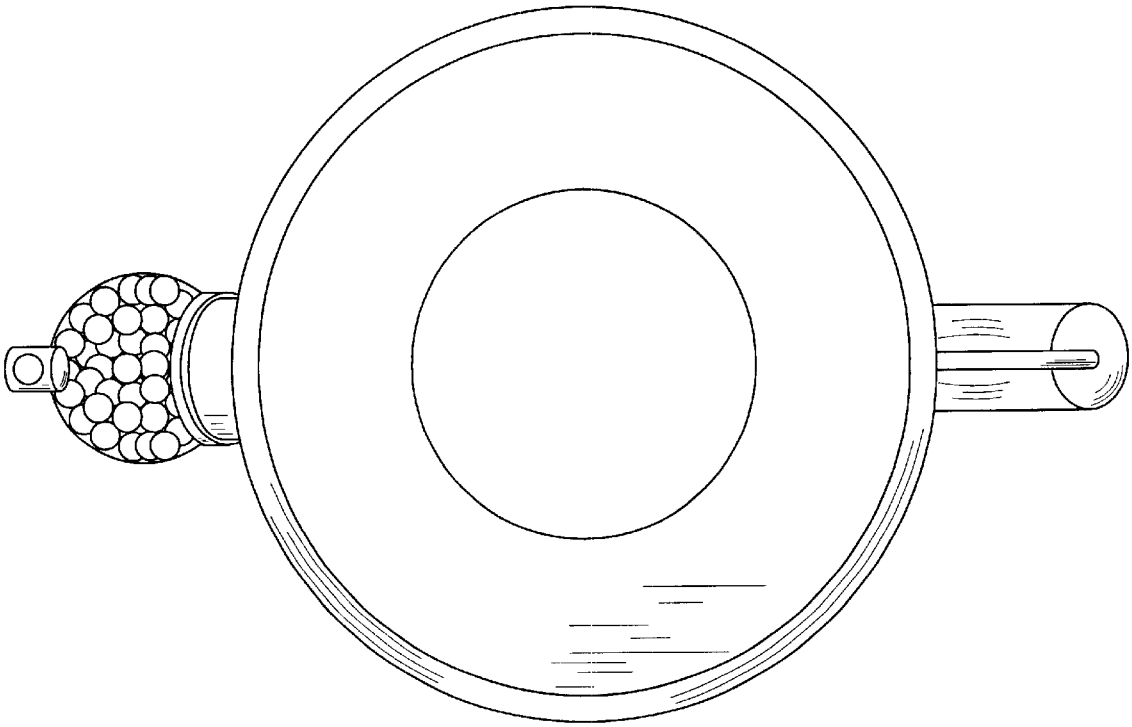
FIG. 7 depicts a bottom view of the exemplary embodiment of FIG. 1.

Shown in FIG. 2 is a right side view of the exemplary embodiment of FIG. 1. FIG. 3 depicts a front view of the exemplary embodiment of FIG. 1. FIG. 4 depicts a left side view of the exemplary embodiment of FIG. 1. FIG. 5 depicts a back view of the exemplary embodiment of FIG. 1. FIG. 6 depicts a top view of the exemplary embodiment of FIG. 1. FIG. 7 depicts a bottom view of the exemplary embodiment of FIG. 1.

Figure 8:
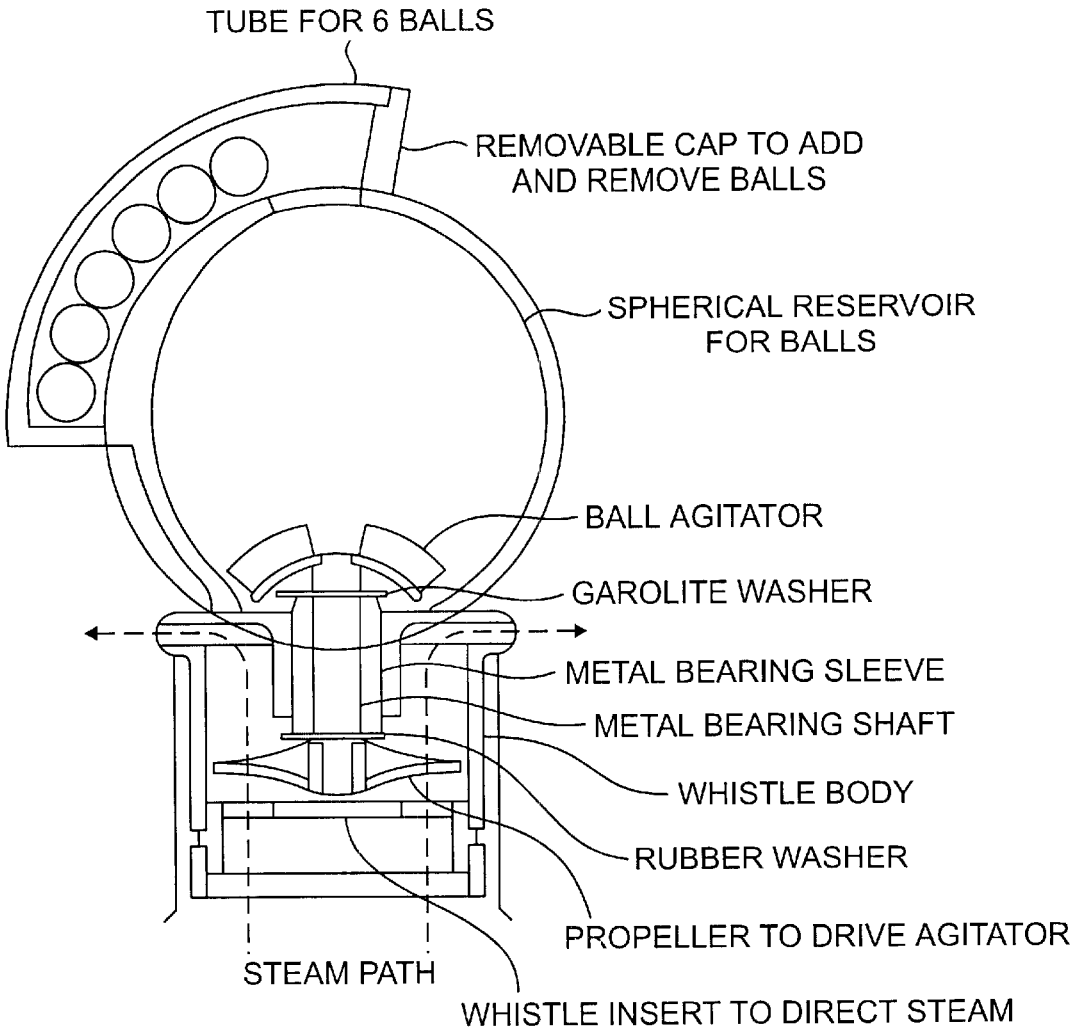
FIG. 8 depicts a detailed cross-sectional view of an exemplary embodiment of a whistle mechanism for use in the exemplary embodiment of FIG. 1 according to another aspect of the present invention.

Referring to FIG. 8, shown therein is a detailed cross-sectional view of an exemplary embodiment of a whistle mechanism for use in the exemplary embodiment of FIG. 1 according to another aspect of the present invention.

The whistle mechanism includes a tube for receiving the balls when agitated by the steam. One exemplary embodiment of the tube provides space for the number of balls in a lottery game, such as six balls. The tube includes a removable cap so that one can add and remove balls.

A spherical reservoir holds the balls. The spherical reservoir is selected to provide sufficient space for ten balls (e.g., one for each digit from zero through nine).

An agitator agitates the balls as the steam is generated.

The whistle mechanism includes a garolite washer, a metal bearing sleeve, a metal bearing shaft, a whistle body, and a rubber washer.

A propeller drives the agitator. The steam generated by the heating water drives the propeller.

A whistle insert directs the steam into the whistle mechanism and propeller.

A steam path exists from the entry point into the whistle mechanism though whistle insert, through the propeller chamber, outside the metal bearing sleeve housing the metal bearing shaft and out through outlet ports provided.

The steam moving through the steam path drives the propeller, which in turn rotates the shaft, which rotates the agitator, which in turn agitates the balls in a random fashion. Randomly the balls fall into the tube, which is designed to hold only a subset of the total number of balls desired to be selected, such as any number from one to ten. One possible exemplary embodiment is to enable the tube to hold only six balls.

What is claimed is:

1. An apparatus for randomly selecting a number, comprising:

a kettle for heating water;

a plurality of balls, each having a number associated with it;

an agitator agitating the balls from steam generated when heating the water; and a tube receiving a subset of the balls.

2. A method for randomly selecting one or more numbers comprising:

agitating a plurality of balls, each having a number associated with it, using steam generated from boiling water; and catching one or more of the plurality of balls fall upon being agitated.

3. An apparatus for use in a kettle for selecting a plurality of random numbers comprising:

a propeller being rotated by steam generated when heating a liquid in the kettle;

a rotatable shaft coupled to the propeller and being rotated by rotation of the propeller;

a plurality of balls, each bearing a character thereon;

an agitator coupled to the rotatable shaft and agitating the balls upon rotation of the rotatable shaft; and a tube for receiving at least a subset of the plurality of balls when agitated by the agitator.

4. The apparatus according to claim 3, further comprising a reservoir holding at least the plurality of balls.

* * * * *

UNITED STATES PATENT AND TRADEMARK OFFICE

CERTIFICATE OF CORRECTION

PATENT NO. : 6,435,501 B2
DATED : August 20, 2002
INVENTOR(S) : Mark Cameron Naden It is certified that error appears in the above-identified patent and that said Letters Patent is hereby corrected as shown below:

Column 1,
Line 11, change “change” to -- chance --.
Line 47, change “rightside” to -- right side --.

Column 2,
Line 47, change “though” to -- through the --.

Column 3,
Line 6, delete “fall”.

Signed and Sealed this

Twenty-fifth Day of March, 2003

JAMES E. ROGAN
*Director of the United States Patent and Trademark Office*